US007063553B1

(12) United States Patent
Mullen

(10) Patent No.: US 7,063,553 B1
(45) Date of Patent: Jun. 20, 2006

(54) QUICK RELEASE SOCKET

(76) Inventor: Nate Mullen, 1240 Simpson Way, Escondido, CA (US) 92029

( * ) Notice: Subject to any disclaimer, the term of this patent is extended or adjusted under 35 U.S.C. 154(b) by 0 days.

(21) Appl. No.: 11/143,309

(22) Filed: Jun. 3, 2005

Related U.S. Application Data

(63) Continuation of application No. 10/705,440, filed on Nov. 10, 2003, now abandoned.

(51) Int. Cl.
*H01R 4/50* (2006.01)

(52) U.S. Cl. ..... 439/336

(58) Field of Classification Search ..... 439/336, 439/337, 642; 362/202, 205, 101, 310, 238
See application file for complete search history.

(56) References Cited

U.S. PATENT DOCUMENTS

| | | | |
|---|---|---|---|
| 2,278,385 | A | 3/1942 | Watts |
| 2,297,374 | A | 9/1942 | Tingle |
| 3,198,462 | A | 8/1965 | Schultz |
| 3,737,837 | A | 6/1973 | Whitehead |
| 4,029,953 | A | 6/1977 | Natoli |
| 4,568,854 | A | 2/1986 | Westlund, Jr. et al. |
| 4,870,548 | A | 9/1989 | Beachy et al. |
| 4,996,636 | A | 2/1991 | Lovett |
| 5,541,826 | A | 7/1996 | Sandell et al. |
| 5,669,703 | A | 9/1997 | Wheeler et al. |
| 5,814,927 | A | 9/1998 | Chen |
| 6,053,623 | A * | 4/2000 | Jones et al. ..... 362/310 |

FOREIGN PATENT DOCUMENTS

JP 08106966 * 4/1996

* cited by examiner

*Primary Examiner*—Alexander Gilman
(74) *Attorney, Agent, or Firm*—Kelly Lowry & Kelley, LLP

(57) ABSTRACT

The present invention comprises a quick release socket and a quick release base. The quick release socket consists of a generally conical shaped housing, a light bulb attachment means in the top surface of the housing, and two electrical contact posts on the bottom surface of the housing. Inside the housing, the light bulb attachment means is electrically connected to the two electrical contact posts. The quick release base consists of a generally cylindrical housing that is open on the top surface, hollowed out on the inside, and closed on the bottom surface. The inside of the bottom surface possess two electrical connection slots. The outside of the bottom surface possesses two electrical input posts. Inside the housing, the two electrical connection slots are electrically connected to the two electrical input posts. The two electrical contact posts of the quick release socket and the two electrical contact slots of the quick release base are designed to engage each other and lock together following insertion and rotation of the quick release socket in the quick release base. The quick release socket and the quick release base lock together by rotating the socket with respect to the base.

2 Claims, 5 Drawing Sheets

QUICK RELEASE SOCKET

CROSS-REFERENCE TO RELATED APPLICATION

Continuation of prior application No. 10/705,440 filed Nov. 10, 2003 now abandoned.

STATEMENT RE: FEDERALLY SPONSORED RESEARCH AND DEVELOPMENT

Not Applicable.

BACKGROUND OF THE INVENTION

1. Field of the Invention

The present invention is directed toward an apparatus for easily replacing light sockets in the event of failure of the fixture. The inventive structure provides for ease of installation, maintenance, servicing and replacement of a socket in a light fixture, in particular, sockets designed to accommodate MR-16 light bulbs.

2. Description of the Related Art

In the prior art, various types of light sockets exist which are designed to accommodate MR-16 light bulbs. Prior art sockets consisted of a single housing which, in the event of failure, required the removal of the entire socket and then the installation of a new socket, including new connections to electrical lead wires. In each of the prior art sockets, the electrical connections which typically failed were made inside of a unitary socket body which is completely sealed and prevents simple repair in the event of electrical failure. Since the prior art device cannot be repaired, it is necessary to remove the entire device and reinstall another device. This can be a difficult and time consuming process considering the dimensions of the socket and the methods of securing the same. The inventor has determined that electrical failure occurs primarily in the portion of the socket where the light bulb plugs into the socket. Electrical failure is less likely to occur in the portion of the socket where the electrical source is connected at the base.

BRIEF SUMMARY OF THE INVENTION

The main object of this invention is to provide an apparatus which facilitates installing maintaining, servicing, and/or replacing light sockets in the event of failure.

Another object of this invention is to provide an apparatus which provides a permanent electrical connection to a quick release base and a disposable quick release socket that easily connects to the quick release base.

The present invention comprises a quick release socket and a quick release base. The quick release socket consists of a generally conical shaped housing, a light bulb attachment means in the top surface of the housing, and two electrical contact posts on the bottom surface of the housing. Inside the housing, the light bulb attachment means is electrically connected to the two electrical contact posts. The quick release base consists of a generally cylindrical housing that has an opening on the top surface, is hollowed out on the inside, and is closed on the bottom surface. The hollowed out inside possess two electrical connection slots. The bottom surface possesses two electrical input posts. Inside the housing, the two electrical connection slots are electrically connected to the two electrical input posts. The two electrical contact posts of the quick release socket and the two electrical contact slots of the quick release base are designed to engage each other and lock together following insertion and rotation of the quick release socket in the quick release base. The quick release socket and the quick release base lock together by rotating the socket with respect to the base.

The housing of the quick release socket and the housing of the quick release base are both constructed from ceramic, or other similarly non-conductive material used in electrical sockets.

BRIEF DESCRIPTION OF THE DRAWINGS

FIG. 4*a* shows a front view of the type of light bulb which the quick release socket of the first preferred embodiment of the inventive apparatus is designed to be used with.

FIG. 4*b* shows a side view of the type of light bulb which the quick release socket of the first preferred embodiment of the inventive apparatus is designed to be used with.

DETAILED DESCRIPTION OF THE INVENTION

The instant invention is designed to provide an apparatus which facilitates installing maintaining, servicing, and/or replacing light sockets in the event of failure. The apparatus comprises unique utilitarian features as described below.

Figure 2:
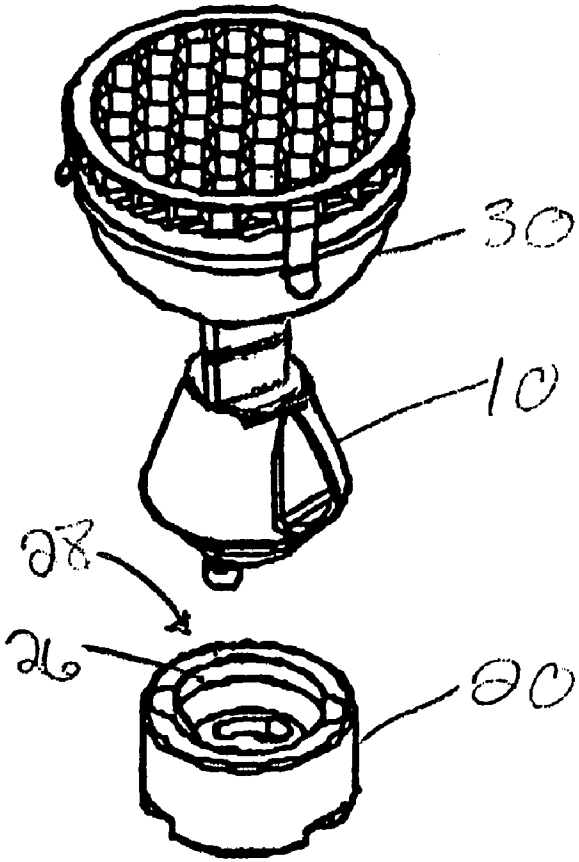
FIG. 2 shows an exploded perspective view of the quick release socket and quick release base of the first preferred embodiment of the inventive apparatus with a light bulb.
Figure 1:
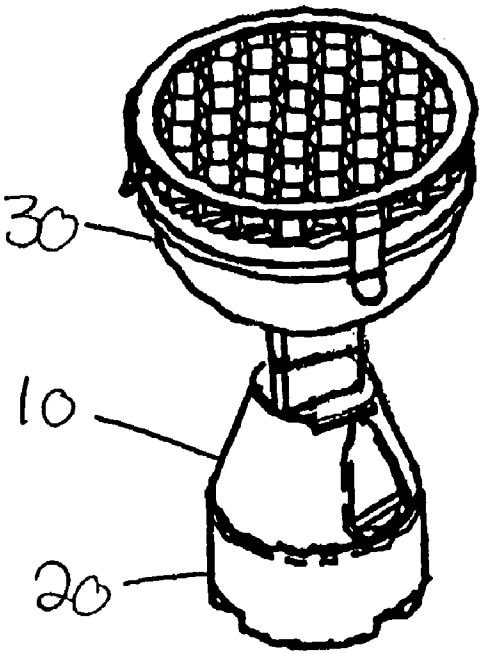
FIG. 1 shows a perspective view of the quick release socket and quick release base of the first preferred embodiment of the inventive apparatus with a light bulb.
Figures 3A, 3B:
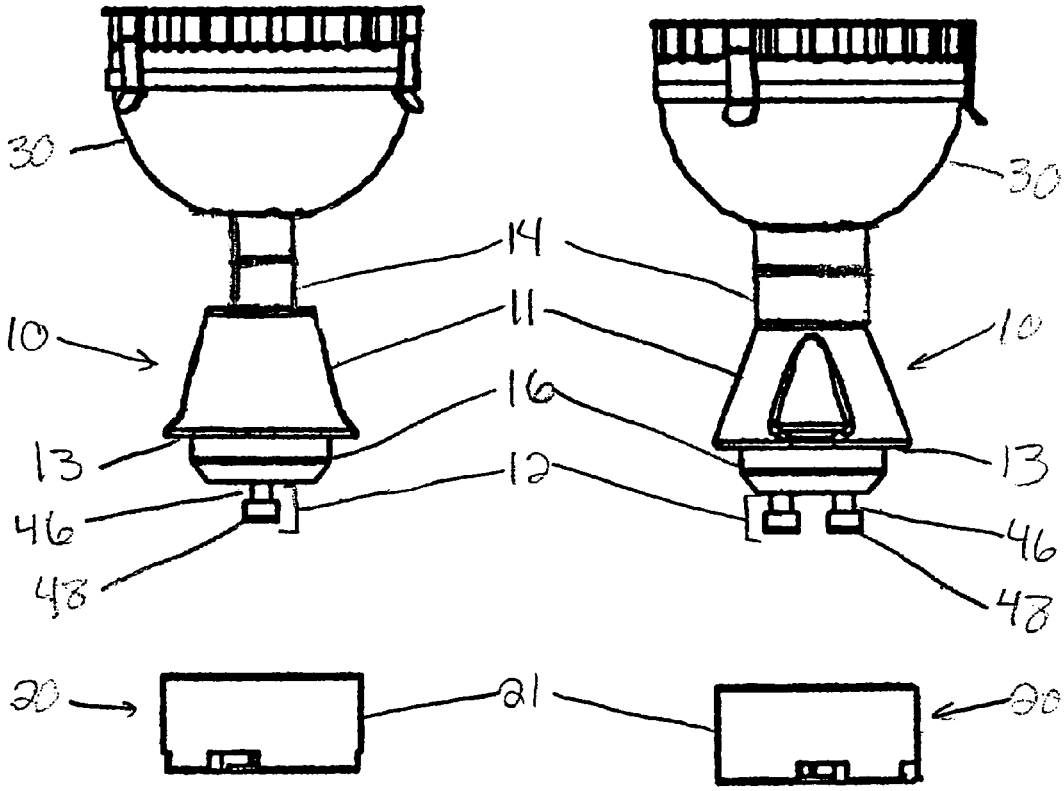
FIG. 3*a* shows a front, exploded view of the quick release socket and quick release base of the first preferred embodiment of the inventive apparatus with a light bulb.
FIG. 3*b* shows a side, exploded view of the quick release socket and quick release base of the first preferred embodiment of the inventive apparatus with a light bulb.
Figures 4A, 4B:
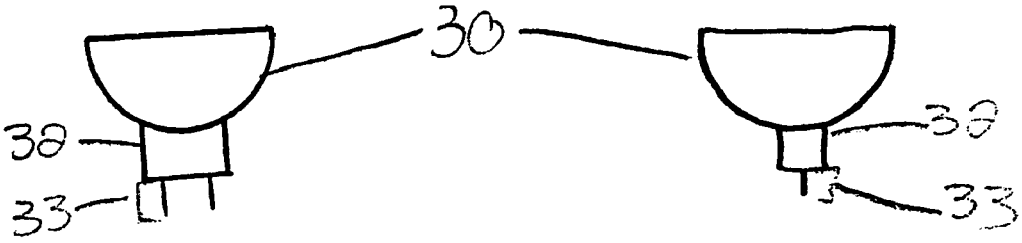
Figure 4C:
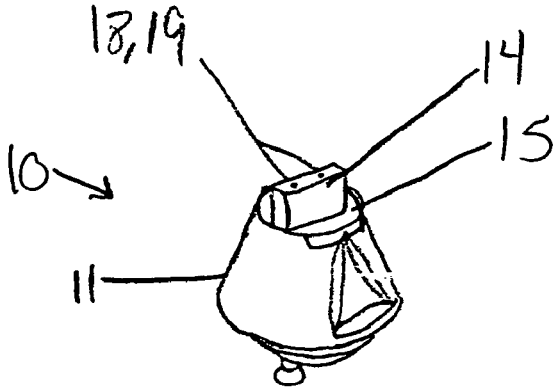
FIG. 4*c* shows a perspective view of the quick release socket of the first preferred embodiment of the inventive apparatus.
Figure 5B:
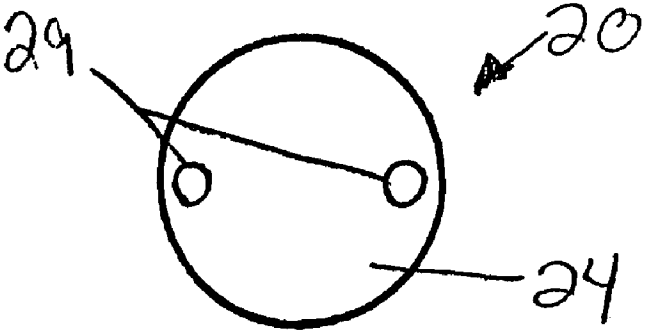
FIG. 5*b* shows a bottom view of the quick release base of the first preferred embodiment of the inventive apparatus.
Figure 5A:
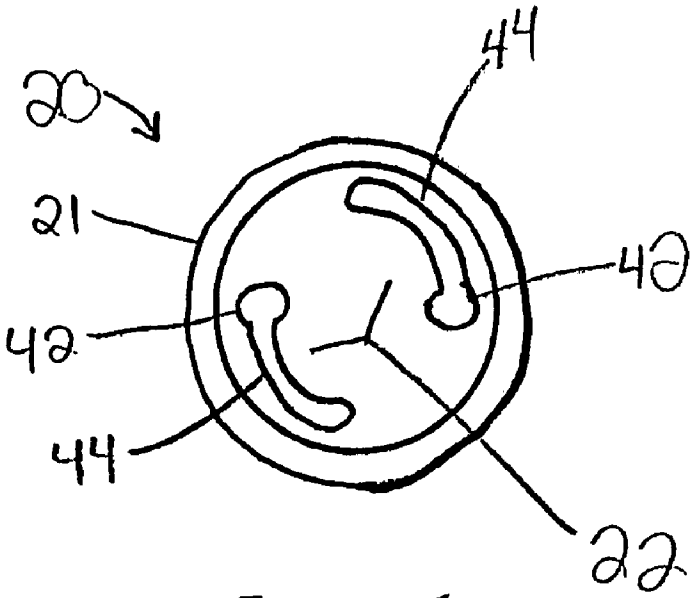
FIG. 5*a* shows a top view of the quick release base of the first preferred embodiment of the inventive apparatus.
Figure 6:
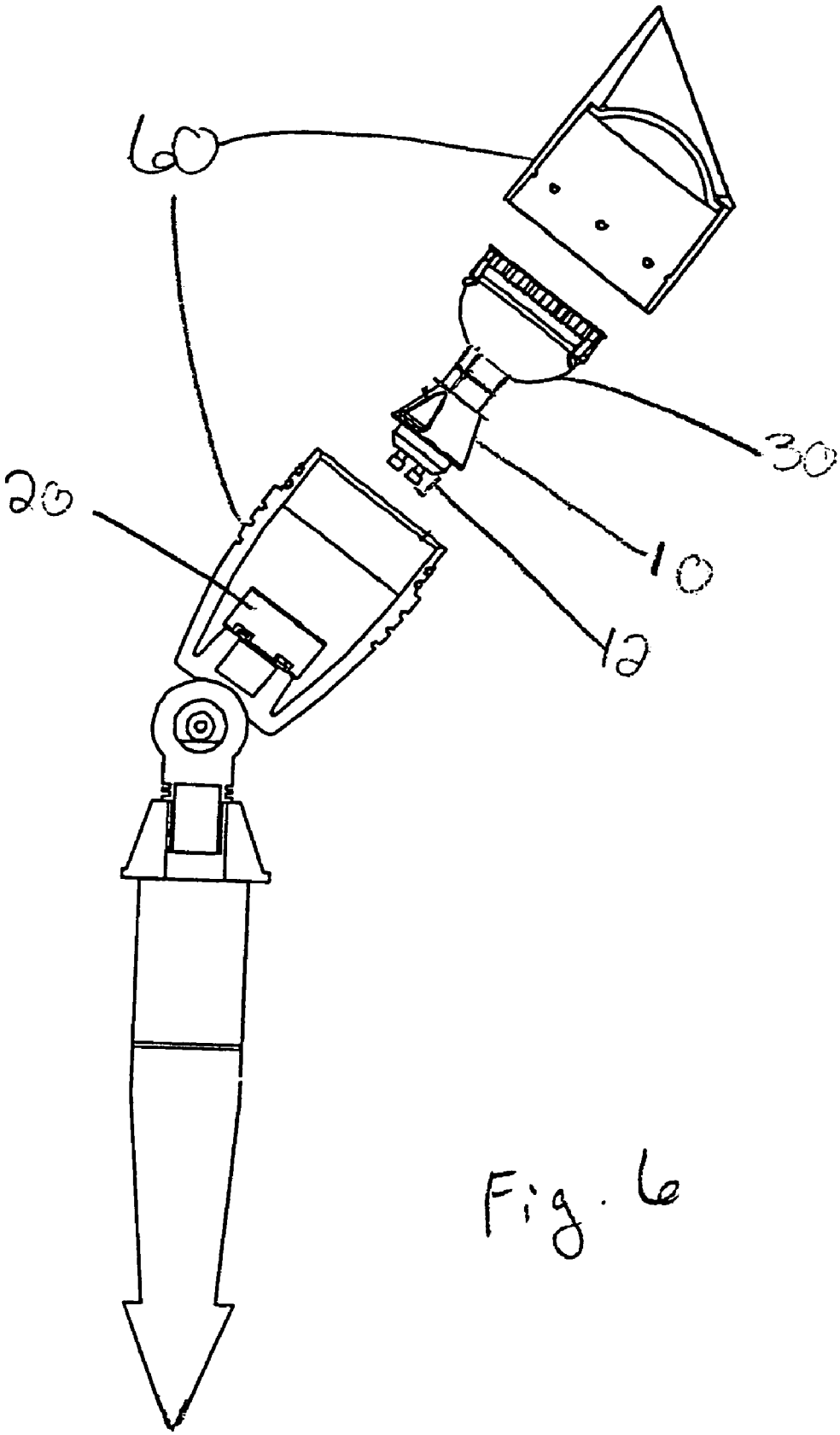
FIG. 6 shows an exploded view of the quick release socket and quick release base of the first preferred embodiment of the inventive apparatus installed in a light fixture with a light bulb.

FIGS. 1 and 2 show the major elements of the instant invention: a quick release socket (10) and a quick release base (20). The quick release socket (10) comprises a pair of electrical contact posts (12), a light bulb attachment platform (14), light bulb attachment means (18), and an insert column (16). The quick release base (20) comprises a pair of electrical contact slots (22), an insert guide (26), and a pair of electrical input points (29).

The quick release socket (10) has a generally conical shaped housing (11) which has a circular bottom (13) and a circular top (15). The light bulb attachment platform (14) on the circular top of the quick release socket (10) possess a light bulb attachment means (18). In the preferred embodiment, the light bulb attachment means (18) consists of two holes (19) containing contact points (not shown) and is designed to accommodate an MR-16 light bulb (30) which possess a complimentary light bulb attachment means (32) in the form of two metal prongs (33). The metal prongs (33)

are inserted in the holes (19) and make electrical contact with the contact points. Alternate embodiments may be designed to accommodate any attachment means known in the art to attach a light bulb to a light socket, i.e. threaded base.

The circular bottom (13) of the quick release socket (10) includes a circular insert column (16) and two electrical contact posts (12) spaced equidistant from each other around the perimeter of the circular insert column (16). The insert column (16) has a diameter slightly smaller than the diameter of the circular bottom (13) on the quick release socket (10). The electrical contact posts (12) consist of a narrow column (46), which is attached to the insert column (16), and an end cap (48) on the end distant from the insert column, which has a diameter slightly larger than the narrow column (46). Inside the housing of the quick release socket (10), the two electrical contact posts (12) are electrically connected to the light bulb attachment means (18).

The quick release base (20) has a generally circular shaped housing (21) which has a flat, closed bottom surface (24) and an inner cavity (28). The top of the quick release base (20) is open to expose to inner cavity (28). The inner cavity (28) has a diameter which is slightly larger than the diameter of the insert column (16) of the quick release socket (10) and is designed to accommodate the insert column (16). The inner cavity (28) includes two electrical contact slots (22) that consist of a circular opening (42) and a narrow groove (44) which is connected to the circular opening (44).

The bottom surface (24) of the quick release base (20) includes a pair of electrical input posts (29). The electrical input posts (29) are designed to connect to an electrical source that provides electricity to the light fixture. Inside the housing (21) of the quick release base (20), the electrical input posts (29) are electrically connected to the electrical contact slots (22).

In operation, the quick release base (20) is permanently secured to a light fixture (60) and electrical lead wires (not shown) are connected to the electrical input posts (29). The quick release socket (10) is then inserted into the quick release base (20) such that the two end caps (48) of the two electrical contact posts (12) are aligned with the two circular openings (42) of the two electrical contact slots (22) in the quick release base (20). Upon full insertion, the end caps (48) of the electrical contact posts (12) will have entered the circular openings (42). The quick release socket (10) is then rotated such that the narrow columns (46) of the electrical contact posts (12) move along the narrow grooves (44) of the electrical contact slots (22). Following rotation, the quick release socket (10) is locked into the quick release base (20). Following the insertion and rotation of the quick release base (10), the electrical contact slots (22) are electrically connected to the electrical contact posts (12) of the quick release socket (10). In this way, electricity is conducted from the electrical source, through the quick release base (20), into the quick release socket (10), and into the light bulb (30).

As the inventor has determined that electrical failure typically occurs in the portion of the prior art light socket analogous to the quick release socket (10), the primary objective of the invention is realized in that, when the light socket fails, the quick release socket (10) can be easily removed and replace by a new piece with operational electrical connections.

The housing of the quick release socket (10) and quick release base (20) can be constructed from any non-conductive material commonly known in the art. In the preferred embodiment, the housing of both the quick release socket (10) and quick release base (20) is constructed from ceramic.

The above-described preferred embodiments are intended to illustrate the principles of the invention, but not to limit its scope. Other embodiments and variations of these preferred embodiments will be apparent to those skilled in the art and may be made without departing from the spirit and scope of the invention as defined in the following claims.

I claim:

1. A quick release light socket apparatus comprising:

a quick release base comprising two electrical contact slots electrically connected to two electrical input posts, wherein the electrical input posts are connected to an electrical source;

a quick release socket comprising two electrical contact posts and lightbulb attachment means;

wherein the lightbulb attachment means is configurable to receive a lightbulb; and wherein the two electrical contact posts are removably connected through rotational attachment to the two electrical contact slots.

2. The quick release light socket apparatus of claim 1, wherein the lightbulb attachment means is configured to accommodate an MR-16 lightbulb.

* * * * *